US010446166B2

(12) United States Patent
Dickins et al.

(10) Patent No.: US 10,446,166 B2
(45) Date of Patent: Oct. 15, 2019

(54) ASSESSMENT AND ADJUSTMENT OF AUDIO INSTALLATION

(71) Applicant: Dolby Laboratories Licensing Corporation, San Francisco, CA (US)

(72) Inventors: Glenn N. Dickins, Como (AU); Paul Holmberg, Marsfield (AU); Dong Shi, Shanghai (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 114 days.

(21) Appl. No.: 15/648,111

(22) Filed: Jul. 12, 2017

(65) Prior Publication Data

US 2018/0018984 A1 Jan. 18, 2018

Related U.S. Application Data

(60) Provisional application No. 62/361,082, filed on Jul. 12, 2016.

(51) Int. Cl.
*G10L 21/02* (2013.01)
*G10L 21/0232* (2013.01)
(Continued)

(52) U.S. Cl.
CPC ..... *G10L 21/0205* (2013.01); *G10L 21/0232* (2013.01); *G10L 25/48* (2013.01);
(Continued)

(58) Field of Classification Search
CPC . G10L 21/0205; G10L 21/0232; G10L 25/48; G10L 2021/02082;
(Continued)

(56) References Cited

U.S. PATENT DOCUMENTS 5,844,994 A 12/1998 Graumann
6,035,046 A 3/2000 Cheng
(Continued)

FOREIGN PATENT DOCUMENTS

EP 2953348 12/2015
WO 2014/032709 3/2014
WO WO-2014032709 A1 * 3/2014 ..... H04S 7/301

OTHER PUBLICATIONS

Shi, G. et al. "Spatial Calibration of Surround Sound Systems including Listener Position Estimation" DTS, Inc. Oct. 8, 2014, pp. 1-7.

(Continued)

*Primary Examiner* — Yogeshkumar Patel

(57) ABSTRACT

Example embodiments disclosed herein relate to assessment and adjustment for an audio environment. A computer-implemented method is provided. The method includes obtaining a first audio signal captured by a device located in an environment. The method also includes analyzing a characteristic of the first audio signal to determine an acoustic performance metric for the environment. The method further includes, in response to the acoustic performance metric being below a threshold, providing a first task for a user to perform based on the characteristic of the first audio signal. The first task is related to an adjustment to a setting of the environment. Embodiments in this regard further provide a corresponding computer program product. Corresponding system and computer program product are also disclosed.

23 Claims, 4 Drawing Sheets

(51) Int. Cl.

| | |
|---|---|
| ***H04R 29/00*** | (2006.01) |
| ***G10L 25/48*** | (2013.01) |
| ***H04S 7/00*** | (2006.01) |
| ***G10L 21/0216*** | (2013.01) |
| ***G10L 21/0208*** | (2013.01) |

(52) U.S. Cl.
CPC ..... *H04R 29/00* (2013.01); *H04S 7/305* (2013.01); *G10L 2021/02082* (2013.01); *G10L 2021/02163* (2013.01); *H04S 7/301* (2013.01)

(58) Field of Classification Search
CPC ..... G10L 2021/02163; H04R 29/00; H04R 29/001; H04S 7/305; H04S 7/30; H04S 7/301
USPC ..... 381/56
See application file for complete search history.

(56) References Cited

U.S. PATENT DOCUMENTS

| | | | | |
|---|---|---|---|---|
| 6,075,868 | A | 6/2000 | Goldfarb | |
| 6,914,989 | B2 | 7/2005 | Janse | |
| 7,139,400 | B2 | 11/2006 | Stuart | |
| 7,826,624 | B2 | 11/2010 | Oxford | |
| 8,050,717 | B2 | 11/2011 | Sugiyama | |
| 8,126,156 | B2 | 2/2012 | Corbett | |
| 8,208,645 | B2 | 6/2012 | Ingalls | |
| 8,219,394 | B2 | 7/2012 | Flaks | |
| 8,363,865 | B1 | 1/2013 | Bottum | |
| 8,824,692 | B2 | 9/2014 | Sheerin | |
| 9,094,768 | B2 | 7/2015 | La Bosco | |
| 2004/0136539 | A1 | 7/2004 | Uhi | |
| 2005/0180582 | A1* | 8/2005 | Guedalia | H04M 3/56 381/92 |
| 2006/0032357 | A1 | 2/2006 | Roovers | |
| 2007/0121955 | A1 | 5/2007 | Johnston | |
| 2009/0012794 | A1 | 1/2009 | Van Wijngaarden | |
| 2010/0135501 | A1 | 6/2010 | Corbett | |
| 2010/0272270 | A1 | 10/2010 | Chaikin | |
| 2013/0216071 | A1 | 8/2013 | Maher | |
| 2014/0294201 | A1 | 10/2014 | Johnson | |
| 2014/0358532 | A1 | 12/2014 | Lin | |
| 2015/0010156 | A1* | 1/2015 | Chen | G10L 21/0205 381/56 |
| 2015/0049583 | A1 | 2/2015 | Neal | |
| 2015/0078596 | A1 | 3/2015 | Sprogis | |
| 2016/0011850 | A1* | 1/2016 | Sheen | H04S 7/301 715/709 |

OTHER PUBLICATIONS

Plinge, A. et al. "Geometry Calibration of Multiple Microphone Arrays in Highly Reverberant Environments" 2014 14th International Workshop on Acoustic Signal Enhancement, pp. 243-247, Sep. 8-11, 2014.

Jost, A. et al. "Transaural 3-D Audio with User-Controlled Calibration" Dec. 7-9, 2000, Proc. of the Cost G-6 Conference on Digital Audio Effects, Verona, Italy, pp. DAFX 1-6.

* cited by examiner

ASSESSMENT AND ADJUSTMENT OF AUDIO INSTALLATION

CROSS-REFERENCE TO RELATED APPLICATIONS

This application claims priority to U.S. Provisional Patent Application 62/361,082, filed on Jul. 12, 2016, which is hereby incorporated by reference in its entirety.

TECHNOLOGY

Example embodiments disclosed herein generally relate to assessment and adjustment of audio installation and more specifically, to a method and system for accessing and adjusting an audio device or the environment where the audio device is located.

BACKGROUND

Audio devices, especially portable audio devices, are used in various environments to provide voice communication, such as capturing audio in the environments and/or rendering audio communicated from other devices. However, such devices suffer a severe range of exposure and use cases. In addition to the quality of an audio device itself, degradation in audio performance can often result from problems in a particular environment that may not be readily identified. Examples of such environment problems include, but are not limited to, noise or vibration near the device, poor placement of the device, problematic acoustic reflections, particularly strong reverberation, loose objects or rattling structures near the device, and the like.

Generally, an audio communication system may have a component of input audio processing that is responsible for removing unwanted noise as much as possible and improving the audio quality without being noticed by the user. However, such audio processing that aims to conceal the problems and improve a desired audio output may also cause some degradation of the audio output. Moreover, the audio device may be used in many different environments. Although device manufacturers or engineers try to design an audio device that can work well over a wide range of environments with the use of the audio processing; there are always some potential problems in the environments that have impairments on the audio input and/or output and may not be removed solely by the audio processing alone.

SUMMARY

Example embodiments disclosed herein propose a solution of assessment and adjustment of audio installation.

In one aspect, example embodiments disclosed herein provide a computer-implemented method. The method includes obtaining a first audio signal captured by a device located in an environment. The method also includes analyzing a characteristic of the first audio signal to determine an acoustic performance metric for the environment. The method further includes, in response to the acoustic performance metric being below a threshold, providing a first task for a user to perform based on the characteristic of the first audio signal. The first task is related to an adjustment to a setting of the environment. Embodiments in this regard further provide a corresponding computer program product.

In another aspect, example embodiments disclosed herein provide a computer-implemented system. The system includes an audio collector configured to obtain a first audio signal captured by a device located in an environment. The system also includes a processing unit configured to analyze a characteristic of the first audio signal to determine an acoustic performance metric for the environment. The processing unit is also configured to determine, in response to the acoustic performance metric being below a threshold, a first task for a user to perform based on the characteristic of the first audio signal. The first task is related to an adjustment to a setting of the environment.

Through the following description, it will be appreciated that in accordance with example embodiments disclosed herein, an acoustic performance metric for an environment where a device is located is determined to indicate whether an audio activity in this environment achieving a high quality and the user can be provided with a task to perform to adjust the setting of the environment. In this way, the quality of an audio activity in the environment can be improved by the user without excessive audio processing by the device and/or assistance from external technician supports. Other advantages achieved by example embodiments disclosed herein will become apparent through the following descriptions.

DESCRIPTION OF DRAWINGS

Through the following detailed description with reference to the accompanying drawings, the above and other objectives, features and advantages of example embodiments disclosed herein will become more comprehensible. In the drawings, several example embodiments disclosed herein will be illustrated in an example and non-limiting manner, wherein.

Throughout the drawings, the same or corresponding reference symbols refer to the same or corresponding parts.

DESCRIPTION OF EXAMPLE EMBODIMENTS

Figure 1:
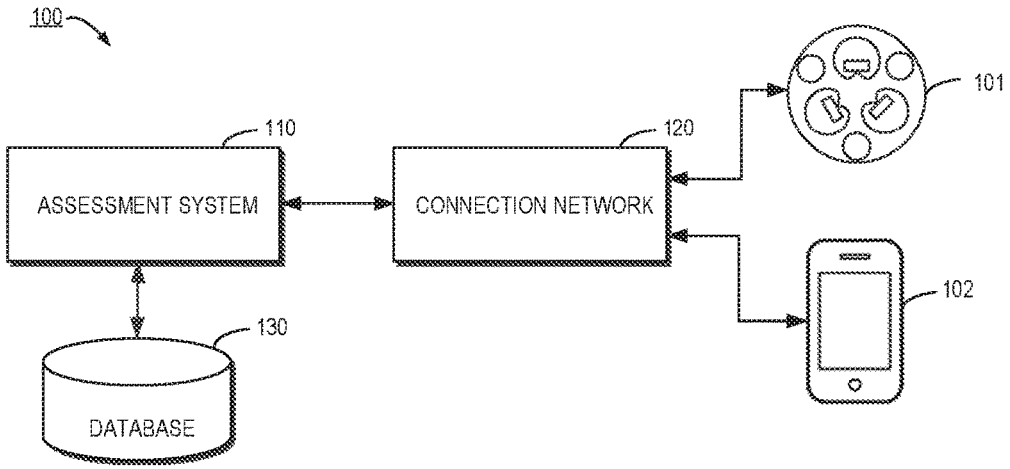
FIG. 1 is a block diagram of an assessment framework in accordance with an example embodiment disclosed herein.

Principles of example embodiments disclosed herein will now be described with reference to various example embodiments illustrated in the drawings. It should be appreciated that depiction of those embodiments is only to enable those skilled in the art to better understand and further implement example embodiments disclosed herein and is not intended for limiting the scope disclosed herein in any manner.

As used herein, the term "includes" and its variants are to be read as open-ended terms that mean "includes, but is not limited to." The term "or" is to be read as "and/or" unless the context clearly indicates otherwise. The term "based on" is to be read as "based at least in part on." The term "one example embodiment" and "an example embodiment" are to be read as "at least one example embodiment." The term "another embodiment" is to be read as "at least one other embodiment". The terms "first," "second," and the like may refer to different or same objects. Other definitions, either explicit or implicit, may be included below.

As discussed above, input audio processing performed within an audio device will cause some degradation on the desired audio output and may not be optimized to all possible installation environments of the device. Some problems may exist in an environment where an audio device is used, for example a conference room and may have impact on the quality of the audio that is captured or rendered by the device. Some of the problems in the environment may not be audible or readily apparent to the user so that he or she may not be able to actively resolve these problems. Generally, for cases where the degradation of audio quality has become problematic, the possible way to overcome the inaudible and veiled problems is to call a support center or request an expert technician for in-situ acoustic consultation and evaluation, which, however, may be time-consuming and costly. Furthermore, there may be subtle degradation which whilst is not deemed problematic but will cause an ongoing and unnecessary degradation to the experience of many users. It would be desirable to automatically detect and resolve the potential problems in the environment to achieve better audio performance and user experience.

Example embodiments disclosed herein provide a solution to assess an acoustic performance of the environment where an audio device is located and then provide suggestions for a user to adjust a setting of the environment and/or a placement of the device when the assessed acoustic performance indicates unsuitability for audio activities of the device in this environment. In these example embodiments, the acoustic performance is assessed with the device being installed and the user can be involved as a part of the process to make the environment more suitable for audio activities. In this way, in-situ environment assessment and adjustment can be achieved without assistance from external technician supports. Furthermore, by integrating an attentive user in the assessment and remediation process, this approach is able to resolve certain ambiguities and avoid complex or excessive audio processing to identify the cause and remedy of common issues. The quality of the device is integral to the device and environment performance. Thus, some example embodiments disclosed herein involve assessing first the integrity of the device in order to use the device as a means of probing and assessing the surrounding audio environment. In some additional embodiments, the quality of the device may be assessed and suggestions may be provided for the user to modify a configuration of the device if necessary.

In some embodiments, the environment assessment for an audio device may be carried out remotely in the sense that a significant amount of processing and inference is performed centrally and can use data from the present device and other sources. For example, a central system may be provided with the functionality of assessing an environment and providing suggestions over the communications system for adjusting the environment. Any audio devices required to test whether an installation environment is suitable for audio activities may be connected to this central system to obtain the provided service. FIG. 1 depicts such a framework 100 used to assess an environment.

As shown, audio devices 101 and 102 may be connected to a remote assessment system 110 through a connection network 120. The audio devices 101 and 102 may be installed in the same or different environments and operated by the same or different users. For example, before a conference starts, the user may want to test whether the environment of the conference room is suitable for audio communication with a high quality using the audio devices 101 and 102. The audio devices 101 and 102 may then be connected to the remote assessment system 110 which is configured to assess whether the acoustic performance of the conference room is suitable for audio capturing and rendering. In order to assess the environment, the assessment system 110 may require the devices 101 and/or 102 to send the captured audio signal for analysis over the connection network 120. In some example embodiments, the same network used in the case of normal communications of the device 101 or 102 may be operated as the connection network 120 for both the transfer of data from the device installation environment and for the return transfer of instructions/suggestions to the user.

The assessment system 110 may be configured to detect any problems in the environment that have impact on the audio quality based on the environment assessment result. Upon determination of the problem(s), the assessment system 110 may provide a corresponding task for the user to perform so as to resolve the problems. The task may be provided to the device 101 or 102 via the connection network 120, so that the user may take certain actions to adjust the setting of the environment/or a placement of the device so as to improve the acoustic performance. In this way, to the local user, the interaction of the in-situ environment assessment and task provision would represent a similar experience to calling an expert technician who has a great capability to take remote measurements to detect and suggest an adjustment for the particular environment. The environment assessment and task provision will be described in further detail below.

In some example embodiments, historical assessment results and corresponding tasks may be stored in a database 130 for a particular device, such as the device 101 or 102. The assessment system 110 may access the database 130 and use the information stored in the database 130 to facilitate the environment assessments and task provisions. Such database may also include aspects of wider data from other similar devices and installations as well as support data and logic in the form of an expert system to facilitate the process of assessment, suggestion, and remediation in the assessment system 110.

Although illustrated as a mobile phone and a conference device in FIG. 1, the audio devices 101 and 102 may be any devices that are capable of capturing and/or rendering an audio signal. For example, the audio device 101 or 102 may be equipped with one or more microphones to capture audio in the environment. Alternatively, or in addition, the audio device 101 or 102 may be equipped with one or more speakers used to render an audio signal received from other devices or captured by the device 101 or 102. It is also noted that the device 101 or 102 may be distributed in a physical space with microphones and/or speakers broadly located, such as satellite microphones and/or speakers placed across the room and communicated with the main device in wired or wireless connections. As a remote system, the assessment system 110 may be assessable to two or more devices or may be specific for only one device.

In some other example embodiments, the environment assessment for an audio device may be performed locally. In these embodiments, the assessment system 110 and/or the database 130 in FIG. 1 may be installed as software in the devices 101 and 102, respectively. In such a case, the connection network 120 may be omitted during the testing process. It is noted that some network connectivity is generally associated with the device being used for communications, though this network connectivity may not always include a link to the central assessment system 110 and therefore the embodiment of a local instantiation of analysis and testing process is envisaged. Furthermore, where there is sensitivity around the devices being able to capture and send audio or listen into a sensitive environment, restrictions on connection and transfer of audio may lead to a preference for a local assessment system with no security implications for the transferred audio.

The device 101 or 102 may be degraded in the hardware or software level over time due to the usage and exposure in the environment. In addition to the environment assessment, in some example embodiments, the assessment system 110 may be configured to assess the quality of the device 101 or 102. In an embodiment, the device assessment may be performed first. In the case that the quality of the device is satisfied for an audio activity, it is continued to assess the environment. This is generally a preferred process in some embodiments as the device itself is utilized in the environmental test as a form of measurement device. Ensuring that there are no catastrophic or limiting faults of the device itself may be important prior to making further diagnosis of the surrounding environment of the device. It would be appreciated that any techniques may be employed for the device assessment. An example of those techniques may be found in U.S. patent application Ser. No. 14/387,171, which is incorporated herein by reference in its entirety. In some embodiments, the assessment system 110 may also determine some tasks which the user may be able to perform to improve the device quality and/or correct impairments of the device based on the device assessment result.

Figure 2:
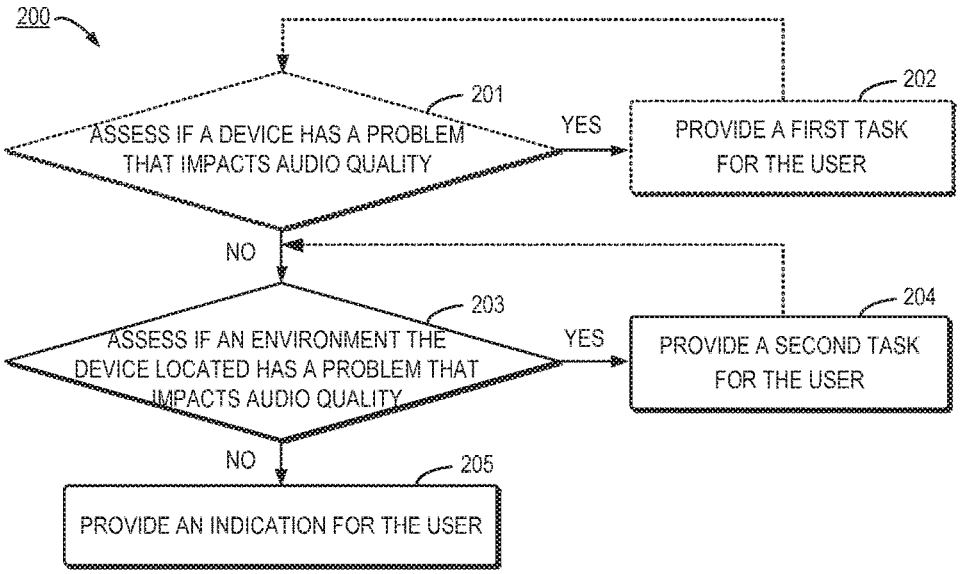
FIG. 2 is a flowchart of a process of environment and device assessments in accordance with an example embodiment disclosed herein.

Reference is now made to FIG. 2 which depicts a process of environment and device assessments 200 in accordance with an example embodiment disclosed herein. In some example embodiments, the process 200 may be implemented by the assessment system 110 in FIG. 1 (which may be an internal or external system to the audio device 101 or 102) to evaluate the quality of the device 101 or 102 and the acoustic performance of the environment where the device 101 or 102 is located.

In step 201, a device is assessed to detect if the device has a problem that impacts audio quality. The problem detected during the device assessment may be related to the quality of the hardware and/or software installed in the device. If a problem is detected, a corresponding first task may be provided for the user to resolve the problem in step 202. The device assessment may be related to evaluating the quality of the device, which will be described in detail below. After the user performs the provided task, for example, after a certain period of time or after receiving a confirmation input by the user, the device assessment (for example, steps 201 and 202) may be repeated until no further problem is detected in step 201.

If no quality problem of the device is detected, the process 200 proceeds to step 203 to assess if the environment where the device is located has a problem that impacts audio quality. In some embodiments, the process 200 may start from step 203 without performing the device assessment in steps 201 and 202. The environment assessment in step 203 may be related to evaluating an acoustic performance of the environment, which will be described in detail below. If the problem related to the environment is detected, a corresponding second task may be provided to the user to resolve the problem in step 204.

In some embodiments, the second task may be related to an adjustment to a setting of the environment. The setting of the environment may be related to the setting of physical objects within the environment, for example, the arrangement of the windows, walls, doors, tables, appliances or other electronic devices, furniture, or other objects located in the environment (including addition, adjustment, or removal of part of the objects), a distribution of the seats, and/or any other aspects related to the process of providing an appropriate arrangement in this environment for an audio activity.

Alternatively, or in addition, the second task may be related to a placement of the device in the environment. As used herein, a placement of a device refers to physical deployment or re-deployment of the device in an installation environment. For example, the placement may include, but is not limited to, a position of the device, an orientation of the device (including the main device, its microphone(s), and/or loudspeaker(s)), a proximity of the device to certain objects and boundaries such as walls or table surfaces, positions and orientations of satellite and auxiliary microphones and/or speakers, removal of loose objects around the device, improvement or changes to the seating of the device and contact on the supporting surface, securing of cables or attachments of the device, and/or any other aspects related to the process of providing an appropriate placement and installation for an audio activity of the device.

Different environment settings and/or placements of the device will affect the way the device operates and thus the audio quality in capturing or rendering activities. Sometimes the user may not be aware of the potential problem in the environment that will cause the degradation of the device. With the provided task, the user may actively take some actions to resolve the problem.

After the problem is handled by the user based on the task, for example, after a certain period of time or after receiving a confirmation input by the user, the environment assessment (for example, steps 203 and 204) may be repeated until the environment is detected to be suitable for audio activity. If there is no problem detected in step 203, an indication is provided for the user in step 205 to indicate suitability of the environment and the device for an audio activity. Therefore, the user can expect an improved audio quality of capturing and rendering provided by the device in the current environment.

In some example embodiments, a variety of triggers or events may be set to initiate the device assessment and/or environment assessment. The triggers or events may include, but are not limited to, time-based triggers, event-based triggers, and user inputs. For example, the assessment system such as the assessment system 110 may determine to perform the device assessment and/or environment assessment for an audio device in a predetermined time frame or after detecting there is an on-going activity in the device. In another example, a user input may be received by the assessment system 100 to initiate the device and/or environment assessment whenever the user wants trouble shooting and/or device remediation.

Alternatively, or in addition, the device and/or environment assessments may be initiated based on an interactive mechanism. Specifically, the assessment system 110 may automatically provide a prompt for assessment to the user (via the audio device, for example) to indicate that an assessment is needed. The assessment system 110 may start to perform the assessment(s) after receiving a confirmation of the user. For example, the assessment system 110 may monitor on-going audio activities of the audio device and provide the prompt based on detecting degradation of audio over a period of time.

In some example embodiments, the first task and/or the second task may be prompted by a system, for example, the assessment system 110 to the user via an audio signal, a visual signal (for example, an image, a video, a text display, a light), and/or any combination thereof. The user may be informed of the first and/or second tasks through the device or other user equipment connected to the assessment system.

It would be appreciated that the device assessment in steps 201 and 202 may be performed before or after the device is installed in a particular environment. It would also be appreciated that the device assessment may be omitted in some cases where the device has the ability to improve the audio quality by automatically adjusting the configuration parameters during the use of the device to overcome the degradation in software or hardware.

Figure 3:
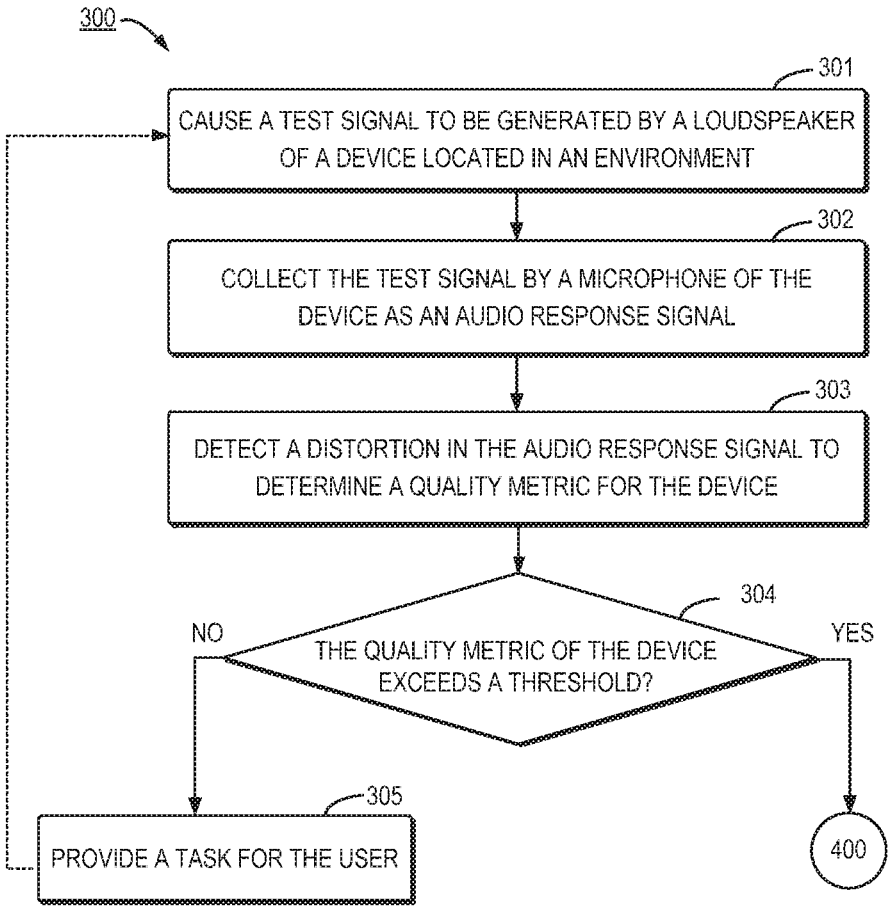
FIG. 3 is a flowchart of a process of device assessment in accordance with an example embodiment disclosed herein.

Some example embodiments for the device and environment assessments will now be described in detail with reference to FIGS. 3 and 4. FIG. 3 depicts a flowchart of a process of device assessment 300 in accordance with an example embodiment disclosed herein. The process 300 may be implemented by the assessment system 110 in FIG. 1 (which may be an internal or external system to the audio device 101 or 102) to evaluate the quality of the device 101 or 102. In some embodiments, the process of device assessment 300 may be initiated by a trigger or event such as time-based triggers, event-based triggers, and/or user inputs as mentioned above.

In the embodiment shown FIG. 3, the device assessment is achieved by using a test signal to detect a distortion in a path from an output transducer and an input transducer of the device (for example, a path from a microphone and a loudspeaker of the device). In step 301, a loudspeaker (or a set of loudspeakers) of a device located in an environment is caused to generate a test signal. There are a number of test signals that could be used such as Maximum Length Sequences (MLS), various pulsed test tones, exponential frequency sweeps, various characteristic sweeps, or any other test signals known in the art as useful for identifying frequency and signal response with linear and non-linear components. The test signal may be already known by the device or may be provided to the device by the assessment system, for example, the assessment system 110 in FIG. 1. The test signal may be played out by the loudspeaker at one or more power levels. In the case where the device has more than one loudspeaker, the test signal may be produced at each loudspeaker separately or simultaneously in some desired combination of loudspeakers.

In step 302, the test signal is collected by a microphone of the device as an audio response signal. The collection of the audio response signal may occur slightly after the generation of the test signal because part of the signal may be designed to exert stress or stimulation of the device in an additional way to the general audio response testing where the audio output and collection are simultaneous. In some example embodiments where the device is equipped with multiple microphones, each of the microphones may capture an audio response signal. In general, the test signal may consist of a broad set of frequency content or excitations. In addition, the test signal may be of finite duration and may have a start time and an end time.

In step 303, a distortion in the collected audio response signal is detected to determine a quality metric of the device. The distortion may be detected by comparing the collected audio response signal with the known test signal. Detection and comparison here may include some signal processing including, but is not limited to, de-convolution, system impulse response determination, frequency response determination, power spectrum, delay estimation, phase estimation, non-linear distortion estimation, noise level estimations, consistency in repeated stimulus, intermodulation, detection of aberrant signal activity presence, classification, level determinations, and/or pattern matching. Such processing may be performed in any suitable combination of direct and transformed signals using known techniques and generalizations such as Fourier, wavelet, sub-banding, or time frequency analysis of either the direct captured signal or the de-convolved and identified system responses and distortion products.

In some example embodiments, a distortion may be detected between the collected response signal and the generated test signal at each pair of microphone and loudspeaker. The distortion may be compared with a threshold distortion to determine a quality metric of the device. The threshold distortion may be obtained from some reference devices and stored for use. In some example embodiments, if the detected distortion in step 303 exceeds the threshold distortion, the quality metric of the device may be determined to be a low value, indicating some potential faults in the device. In other cases, the quality metric of the device may be determined to a higher value.

Then the quality metric may be compared with a threshold for quality in step 304. The threshold for quality may be set based on actual requirements, for example, the user's tolerance. If the quality metric is below the threshold, which means that there may be some faults existing in the device, then a task is provided in step 305 for the user. The task may be determined based on the distortion and may indicate a modification to a configuration of the device. As used herein, a configuration of a device includes various aspects of hardware and/or software configurations within the device. The modification of the device configuration may include replacement or repairing the hardware components, or modifying parameters for the hardware components and/or the signal processing methods used by the device. For example, if a high rub and buzz distortion is detected, the task may be provided to require the user to take certain actions to adjust parameters for the audio capturing and rendering or for other audio processing, replacing some aging components, and the like. In some other examples, if the device remediation and support from an expert technician is required, the task may also include such suggestions.

In some example embodiments, the configuration of the device such as the parameter setting of the components and audio processing may be automatically modified by the assessment system or the device. In this case, the task in step 305 may be performed internally without interaction with the user. In some example embodiments, as an option, the process 300 may return to step 301 to assess the device assessment again after the user has performed the task provided in step 305, for example, after a certain period of time or after receiving a confirmation input by the user.

In the case where the quality metric exceeds the threshold, it will proceed, immediately or after the device is installed in the environment, to a process of environment assessment 400 as described below with reference to FIG. 4. In some other embodiments, the process 400 may be initiated by a user input received after checking that there is no quality fault in the device by the process 300. Additionally, an indication may be provided to the user to indicate that the quality of the device is satisfied after step 304.

Figure 4:
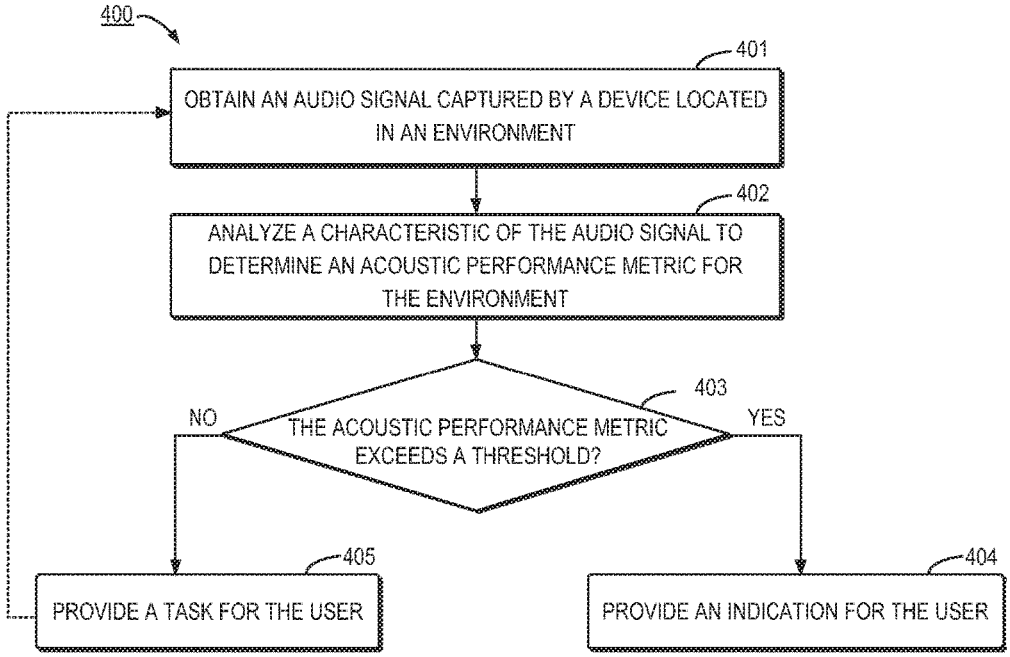
FIG. 4 is a flowchart of a process of environment assessment in accordance with an example embodiment disclosed herein.

FIG. 4 depicts a flowchart of a process of environment assessment 400 in accordance with an example embodiment disclosed herein. The process 400 may be implemented by the assessment system 110 in FIG. 1 (which may be an internal or external system to the audio device 101 or 102) to evaluate the acoustic performance of the environment where the device 101 or 102 is located. It would be appreciated that the process 400 may be performed without the process of device assessment 300 in some other embodiments.

In step 401, an audio signal captured by a device located in an environment is obtained. The environment assessment may be determined based on any captured audio signal by the device, without limiting to the test signal only as the device assessment. In some example embodiments, the device may monitor and capture audio signals in a long period of time and use all the captured signals to assess the environment.

In some example embodiments, there are different modes for capturing the audio signal used for the environment assessment, including a passive mode, an active mode, and an interactive mode. The selection of one or more among these modes may depend on a characteristic of the audio signal to be analyzed, which will be discussed below. In the passive mode, the device may capture the audio signal of an on-going audio activity. In some example embodiments, according to the passive mode, the environment assessment process may be initiated by some time-based triggers and/or event-based triggers mentioned above so as to avoid disruption of the on-going activity.

In the active mode, the device may be caused to actively generate a test signal by the loudspeaker(s) and capture the audio response at the microphone(s) of the device in a similar way to the device assessment process. In an embodiment, triggers such as time-based triggers, event-based triggers, and user inputs may be used to trigger the device to generate the test signal.

In the interactive mode, an activity of a user is requested to provide some additional audio stimulus or comment on the audibility of an audio signal via one or more indications issued over the device. In this mode, the assessment may be triggered by a user input and/or based on an interactive mechanism as mentioned above. In some example embodiments, the indications may be utilized to guide the user to perform a certain activity. Before issuing the indications, in an embodiment, an instruction may be first provided to instruct the user to place the device at a desired position in the environment.

In one embodiment, depending on the indications, the user may be required to keep silence if the device is caused to capture noise the environment. Alternatively, or in addition, an indication may be offered to request the user to make a sound, for example, to read a passage at a normal speech level of a talker at a specific position in that room. In the case where there may be a plurality of potential talking spots in the environment, one or more indications may be provided to guide the user to make sounds at different potential talking spots. A sound of the user at each of the potential talking spots may be captured by the device for analysis later.

The captured audio signal(s) may be useful to facilitate the environment assessment. For example, by analyzing characteristic(s) of the audio signal(s), it may be possible to determine distances from potential talkers to the device, angles of locations of the talkers relative to the device in the room, the orientation/placement of the device, and/or the size of the room or the table where the device is placed. The analysis of the audio signal will be discussed in detail later. In some embodiments, the user may also be asked to comment on the sound they hear from the device at the one specific location or at all the potential locations in terms of it being heard clear, muffled, loud, soft, or other potential high level descriptors, for example. The comments from the user may improve the accuracy of the analysis result.

In step 402, a characteristic of the audio signal is analyzed to determine an acoustic performance metric for the environment. The acoustic performance metric is used to measure the performance of this environment in term of audio activity. In some example embodiments, in order to determine the acoustic performance metric more accurately, characteristics of audio signals captured by the device prior to the current audio signal in the environment may also be obtained to determine the acoustic performance metric. In one embodiment, the characteristics of the prior audio signals may be stored in a storage device that is accessible to the assessment system, such as the database 130 in FIG. 1.

The characteristic of the captured audio signal may include a variety of measurable features from the audio signal. In some example embodiments, a noise characteristic of the audio signal may be detected, which may indicate one or more of a noise level, noise stability, or a relative level of an undesired background speech in the first audio signal, or any other aspects of undesired noise in the environment. Alternatively, or in addition, an acoustic characteristic of the audio signal may also be determined. The acoustic characteristic may indicate a timbre of the audio signal, a reverberation time of the audio signal, an echo level of the audio signal, or a rattle level of the audio signal. In some other embodiments, the distance from a location of a sound source detected in the audio signal to the device in the environment may also be detected from the audio signal and used to determine the acoustic performance metric.

In some cases where the device supports a spatial audio mode, in order to improve the spatial diversity of the audio activity in this environment, a span of locations of sound sources in the environment and/or a separation of sound sources in a sound field may be determined. In these cases, the device may include a plurality of microphones and loudspeakers. The audio responses captured at the plurality of microphones may be used to analyze the span and/or separation.

In the following, the determination of some factors of the characteristics listed above and their impacts on the acoustic performance of the environment will be discussed in detail.

Noise Level

The detection of noise may be taken in a passive mode, where the audio signal is captured during the time of audio activities of the device. It is possible to detect for a segment of audio without any clear speech like activity and use this segment as a noise signal. The noise signal may also be extracted from the audio signal containing speech. In some other embodiments, it may be interactive in that the user in the environment may be informed of recording noise and required to remain quiet. In many use cases of the audio device, the noise level may be estimated using a set of observations of spectral information from the audio signals captured by the microphone(s). In some examples, the amplitude of the detected noise signal may be measured as the noise level. The noise level may be used to indicate the possible noise sources in the environment.

Noise Stability

With the noise signal detected from the captured audio signal either in the passive mode or in the interactive mode as mentioned above, the stability of the noise signal may also be determined. The background stationary noise generally has smooth or constrained temporal variations, but voice activity detection and intermittent bursts may both create a higher range of variations than the stationary noise.

In order to detect the noise stability more accurately, in some examples, the noise stability may be determined using a set of observations of the noise levels over a period of time. For example, the noise stability may be a measure in dB/min and may represent a combination of the frequency and severity of noise disturbances. The noise stability may be used, independently or in combination with the noise level, to indicate possible noise sources in the environment.

Background Speech

The background speech (also referred to as a "mumble" speech) refers to voice leaking in from audio activities away from the device that are not related to its use, for example, speech from adjacent rooms. This mumble or background speech may also be undesired audio in many use cases and may be regarded as noise. However, unlike the discrete impulsive noise, the background speech has cadence modulated noise (for example, spectral modulation at 3-7 Hz) which may falsely be identified as a desired speech, resulting in some issues of gain control or degradation in the audio processing of the device. One example of the issues is that a device installed in a room where participants remain quiet will continually identify and track this background speech causing problems to far end users. Depending on the installation, it is uncertain if the background speech is of interest to the conference, or if it is avoidable. Therefore, the process of the main room being silent and the device testing the level of undesired background speech is useful for both quantifying the effect and potentially resolving the background speech tracking problem in device settings. In this case, it would be desirable to remove or mitigate the background speech before it is captured by the device. In some examples, the background speech may be detected from the captured audio signal and a relative level of the background speech compared with a normal level of desired speech may be calculated.

In some embodiments, the audio signal may be captured in the passive mode during the time where speech is not in progress in the environment. In some other embodiments, the user may be requested in an interactive mode to remain silent in the environment. The audio signal captured during the time of the passive or interactive mode may be used to measure the relative level of the background speech by identifying speech contained therein. In some embodiments, a relative level higher than a threshold may indicate the presence of the background speech. In some embodiments, such background speech (if identified) may be resolved by closing a door or moving a device away from the source of the undesired speech.

Timbre

The timbre of the captured audio signal may be determined by the spectral profile of the signal. An example measure of timbre is a deviation of the audio signal from a reference audio response at multiple suitable frequency bands. In one example, ⅓ octave bands may be used to obtain a set of around 20 spectral points. If there is a higher difference between the highest and lowest variation of the spectrum of the captured audio signal compared with the reference spectrum, there is a noticeable degradation of the speech quality. Generally, degradation of the timbre may be caused by the inappropriate placement of the device.

In some example embodiments, the audio signals captured in a long period of time may be used to evaluate the level of the timbre in a more accurate way. Generally, the expected long term spectra of speech are known and relatively language independent such that major excursions of timbre can be identified. The device may capture the audio signal in a passive mode by collecting the audio signal from the audio activities of the device. The device may also be caused to generate a test signal, for example, create the scattering of sound in the environment and then collect the audio response at the microphone. Alternatively, the user may be involved in the interactive mode and may be offered an indication to make a sound for the microphone of the device to capture.

Reverberation

The reverberation time of the audio signal in the environment may be measured by monitoring the maximum decay rate of energy after impulsive sounds of the audio signal. In order to measure the reverberation time, the audio signal may be captured in any of the passive mode, the active mode, or the interactive mode. In the interactive mode, the user may be asked to clap his hands at one or more suggested distances from the device so as to provide an immediate measure of the reverberation in the environment. The reverberation may usually happen in an enclosed space, for example, a room. The time of the reverberation may be related to the room size or the sound absorption in the room. If the reverberation time is higher than a threshold, it may impair speech intelligibility of the device.

Echo

To measure the echo, a test signal may be used so as to measure the signal level in the direct echo path. Generally, an increase in the echo path may be considered as a device fault. In some other embodiments, a close inspection of the acoustic path within a short distance from the device may alternatively provide an indication if there is any large reflective objects around the device. A large echo level may have a significant impact on the duplex performance of the device.

Rattle

The level of rattle may be measured by generating a test signal and capturing the audio response at the microphone(s) to determine a distortion. The distortion may be determined in a similar way to what is described in the process of device assessment. In some embodiments, the level of rattle may be measured as a relative level of the rattle compared with a normal level of desired speech. An increase in the immediate harmonic distortion may be related to a problem of rattle. The rattle may be related to some loose or rattle objects closed to the device and stimulated by the test signal. The rattle sounds made by those objects may be significant enough to be captured by the microphone. This may be very problematic if the rattle level reaches a level nearing the desired speech in the environment.

Distance

The distance between the device and a sound source (for example, a user) may also have impact on the acoustic performance of the environment. As mentioned above, the user may be requested to make a sound at one or more potential talking spots so that the distance(s) between the device and the talkers at the talking spot(s) may be determined based on the captured audio response. In some embodiments, if there is a plurality of distances determined for different sound sources, a mean distance may be calculated. Ideally, the talking person should stay within a short range of a microphone for good audio capture in an environment. In some example embodiments, instead of requiring the user to make sounds, distances from the sound sources to the device may be detected from a long time of observations of the audio signals collected from the audio activities of the device. If the distance is detected to be larger than a threshold (which is dependent on the capability of the microphone used), the microphone may potentially not be able to capture the speech from the user at an acceptable level.

Span and Separation

The span of multiple users in the environment and the separation of their sounds in the sound filed will have a significant impact in the case of a spatial audio mode. As mentioned, in this mode, the device may have more than two microphones and loudspeakers. Generally, there may be a plurality of sound sources captured when this mode is activated and a spatial diversity may be obtained in the audio capturing and rendering. In order to measure the span and the separation, the audio signal may be collected from the audio activities of the device or in an interactive mode where the user may be requested to move across a plurality of talking spots and make some sounds.

The span of the sound source may be represented by a range of angles of the sound sources (in some examples, only angles of the speech sound sources) detected from the audio signal. A mean angular separation of all the detected sound sources in the sound filed may be measured. The span and the separation may be used to indicate the relative distribution of the users with respect to the device in the environment.

Some factors indicated by the characteristics of the captured audio signal are discussed above. In some example embodiments, an acoustic performance metric for the environment may be determined based on one or more of those factors, so that the user can interpret the overall performance of this environment from the metric. In some examples, each of the concerned factors may be scaled or mapped into a degradation value within a same range in a linear or non-linear way. The range for mapping may be selected as, for example, a range of 0 to 1, 0 to 10, 0 to 100, or any other suitable range. The measured value for each of the concerned factors may be first mapped into a value in this range and then all the mapped values of the factors may be weighted to obtain the acoustic performance metric for the environment.

The weight for each factor may be used to represent the extent to which this factor may impact the audio activity in the environment. For example, since the span and the separation are only of significant impacts in the case of a spatial audio mode, one or both of them may not be strong contributors to the acoustic performance and thus may have relatively low weights. In some cases where some factors may require more obseverations at the microphones to determine their values at the present time, the acoustic performance metric may also be created, for example, by assigning those factors with typical values. The typical values may be selected as 0.4, 0.5, 0.6, or any other values in the range of 0 to 1, or may be selected as other values if a different range for mapping is used.

A detailed working example of the mapping and the weights of some factors are listed in Table 1 below. In Table 1, the measured factors are all scaled (or mapped) into a range of 0 to 1. For example, for the factor of noise level, any levels measured for this factor that are lower than 40 dB may be scaled to the value of 0 while those higher than 70 dB may be mapped as the value of 1. For other levels between 40 dB and 70 dB, they may be mapped to a value higher than 0 but lower than 1 in a linear or non-linear way. In the example of Table 1, the weight for the noise level may be set as 10%. Other factors may be scaled into the range of 0 to 1 in a similar way. It would be appreciated that Table 1 is given merely for the purpose of illustration, without any limitation to the embodiments disclosed herein. Any other ranges of values and/or weights may be set for these factors.

TABLE 1

| Factor | Unit | 0 | 1 | Weight (%) | Notes |
|---|---|---|---|---|---|
| Noise Level | dB | 40 | 70 | 10 | A stationary background noise level; Measured as A weighted dB SPL (sound pressure level) |
| Noise Stability | dB/min | 3 | 30 | 8 | Sudden or impulsive fluctuation(s) in background noise; Measured as average peak/jump x burst events per minute |
| Background Speech | dB | −40 | −10 | 6 | Presence of undesired low level speech; Measured as relative dB to the normal desired speech level |
| Timbre | dB | 3 | 20 | 4 | Spectra variation of the desired speech; Measured as dB variation in ⅓ 8$^{ve}$ bands |
| Reverberation | ms | 200 | 2000 | 8 | Smearing of sounds in the environment; Measured as the time required for the sound energy density to decay 60 dB at a typical position |
| Echo | dB | 3 | 10 | 5 | Echo caused due to nearby reflections; |
| Rattle | dB | −40 | −10 | 10 | Non-linearity above that expected from device; Measured as dB relative to a level of the typical desired speech |
| Span | deg | 360 | 0 | 3 | A range of angles from which people potentially speaking; Measured as the span of observed speaking positions |
| Separation | deg | 120 | 0 | 3 | An effective angular separation between different users; Measured as the end mean separation in |

TABLE 1-continued

| Factor | Unit | 0 | 1 | Weight (%) | Notes |
|---|---|---|---|---|---|
| | | | | | the sound field |
| Distance | m | 2 | 12 | 10 | A (mean) distance of the user(s) to the microphone(s) of the device |

In some example embodiments, some or all of the factors listed in Table 1 and/or other additional factors may be selected to determine the acoustic performance metric. The selected factors may indicate the components having influence on the audio quality and may be used to determine an overall score which provides utility for tracking the acoustic performance of the installation environment.

In some example embodiments, the acoustic performance metric may be determined as being positively related to the values of the concerned factors. In an embodiment, determining of the acoustic performance metric may help to reduce the variety of measurable factors (characteristics of the audio signal) into a smaller number of scoring dimensions, which may facilitate the user interpretation on the acoustic performance.

In one embodiment, the acoustic performance metric may be determined as a weighted sum of the values of the concerned factors. The values of the factors may be weighted and added up to obtain a value in a predetermined range such as a range between 0 to 1, 0 to 10, or 0 to 100, or any other suitable range. For example, if it is decided to limit the acoustic performance metric in a range between 0 to 10 and let the metric with a higher value indicate a better acoustic performance, the acoustic performance metric may be determined as 10 minus a product of 10 and the weighted sum. In some examples, the weighted sum may be constructed as an exponential function by using an exponential index. The acoustic performance metric in these examples may be represented as follows:

$$S = 10 - 10\left(\sum_{f=1}^{F} (W_f * C_f)^n\right)^{1/n} \tag{1}$$

where S represents the acoustic performance metric, F represents the number of factors concerned in the determining of the performance metric, $C_f$ represents the mapped value of the fth factor, $W_f$ represents the weight for the fth factor, and n represents an exponential index. The exponential index n may be equal to or larger than 1. In some embodiments, a higher value of n may lead the acoustic performance metric being closer to the characteristic caused by the most significant weighted degradation. In one example, the value of n may be set to 2. In one example, the values for scaling and weighting of those measurable factors may be those as shown in Table 1.

It would be apprecited that the acoustic performance metric may be determined as a value in any other ranges than that is shown in Equation (1) based on the weighted sum of the concerned factors. It would also be appreciated that other forms of weighting may be employed.

In some other embodiments, more than one metric may be determined based on the values of the factors, used to indicate the acoustic performance. For example, a metric may be determined based on factors related to the noise characteristic of the audio signal captured by the audio device, such as the noise level, the noise stability, and/or the background speech. One or more other metrics may be determined based on the acoustic characteristic of the audio signal and/or any other characteristic.

Referring back to FIG. 4, the acoustic performance metric determined in step 402 may be compared with a threshold in step 403 to decide whether the environment is suitable for an audio activity. An acoustic performance metric with a higher value may indicate that the environment is more effective for the audio activity. The threshold for the acoustic performance metric may be determined based on actual requirements. In the example of Equation (1), the acoustic performance of the environment may be broadly characterized as ineffective in the case of an acoustic performance metric within a range from 0 to 3, as problematic in the case of the metric within a range from 3 to 7, and effective in the case of the metric within a range from 7 to 10.

If the acoustic performance metric is determined to exceed the threshold (for example, a threshold value of 7 in the example of Equation (1)), then an indication may be provided for the user to indicate suitability of the environment for audio activities in step 404. Otherwise, the process 400 proceeds to step 405. In the embodiments where two or more acoustic performance metrics are determined, each of the metrics may be compared with a respective threshold (or the same threshold). If all or most of the metrics exceed the corresponding threshold, the process 400 proceeds to step 405.

In step 405, a task is provided for the user to perform so as to improve the acoustic performance of the environment. The task may include one or more actions to be performed by the user. In some embodiments, in addition to the overall score, an indication of the factor(s) that is causing the major (or largest) degradation may also be useful to determine which action(s) in the task may be of a higher priority. In some examples, the factors may be sorted for analysis based on the values representing their impacts on the degradation, for example, based on the values of $W_f$*$C_f$ in the example of Equation (1).

In some example embodiments, the task may be related to an adjustment to a setting of the environment. Alternatively, or in addition, the task may be related to a placement of the device. The task may be determined based on the characteristic(s) of the audio signal detected in step 402. In some example embodiments, the audio device or the assessment system may have the intelligibility to analyze the reasons for the low acoustic performance metric and then determine a possible solution as the task for resolving the problems.

In some example embodiments, based on the noise characteristic indicating factors such as the noise level, or noise stability, it can be determined that the low acoustic performance metric may be caused by some noise sources. A task may be used to guide the user to check if there may be an electronic device or appliance turned on, or a window or door opened and take an appropriate action to eliminate or suppress the noise. For the case of vibration noise detected from the noise level and/or noise stability, a task may indicate to the user to move the device from some mechanical vibration noise sources. In some examples, if a relative level of the background speech is higher, a task may suggest the user to close the window or door in the environment or improve the sound insulation effect of walls of the environment.

In some example embodiments, the extracted noise signal may be played back so that user can identify the characteristic sound of the disturbance and find out the noise sources. This approach of playing back what the device captures is quite powerful. Generally, the input signal processing works to overcome the deficiencies of the audio as captured at the microphone(s) of the device. By simply replaying a sequence of test audio or room capture exactly as it was heard at the microphone(s) and potentially adding amplification to create a suitable output level, the user may be able to quickly hear, identify, and rectify noise sources near the device which may be otherwise inaudible in the larger room. In some other embodiments where the device is equipped with spatial microphones, it may be possible to determine the primary direction of a noise source based on the audio signals captured by the microphones. The determined direction may be given as a suggestion to the user.

In some example embodiments, if the distance of the user or the mean distance of multiple users is large, the user(s) may be suggested to stay closer to the device or use satellite microphones and/or speakers to help capture the speech and/or listen to the audio playback. Alternatively, or in addition, the acoustic characteristic indicating factors such as the timbre, the reverberation time, the echo level, or the rattle level may also be used to determine possible problems existing in the environment that impacts the performance metric. For example, degradation from the timbre and unexpected near echo may be caused by the poor placement of the device and then a task may be provided to the user to move the device to another suitable place.

A longer reverberation time may due to the large room size or the poor sound absorption of the walls. In this case, an acoustical treatment may be recommended to the user. For example, the user may be suggested to use some soft furnishings in the room, pull down any soft window or wall dressings, or open the door to reduce reverberation. The rattle level is high, which is generally caused by some loose or rattle objects closed to the device, a task may be given to request the user to check and adjust objects surrounding the device.

In some other example embodiments, the acoustic characteristic indicating factors such as the span and the separation of the users may be used to detect the relative distribution of the users with respect to the device in the environment. In some examples, a low span and a low separation may be resulted from the users being far from the device and thus a task may be determined to request the user to move closer. If the span is high while the separation is low, it may be the case where the room is big and multiple participants stay at distant seats. Therefore, the user may be suggested in the task to use microphones and/or speakers to help capture the speech and/or listen to the audio playback. In some other cases where the span is high and the separation is low, it may be determined that the device is located in a corner or in a position near to a wall. The user may then be suggested to change the position of the device or the orientations of the microphones and loudspeakers of the device.

In some example embodiments, as an option, the process 400 may return to step 401 to assess the environment again after the user has performed the provided task, for example, after a certain period of time or after receiving a confirmation input by the user. In some example embodiments, a plurality of potential tasks determined from the environment assessment may be listed for the user, for example, in a descending order according to the severity of the detected problems. Additionally, the correspondence between the tasks and the problems may also be provided. The user may then be able to attempt to take some actions based on the listed tasks to resolve the potential problems in one round of environment assessment.

Figure 5:
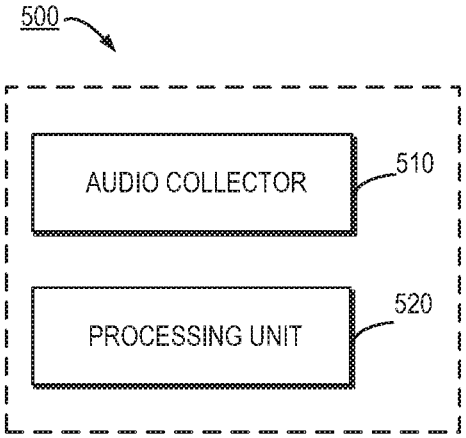
FIG. 5 is a block diagram of a system in accordance with an example embodiment disclosed herein.

FIG. 5 depicts a block diagram of a system 500 in accordance with another example embodiment disclosed herein. The assessment system 110 in FIG. 1 may be implemented as the system 500. As shown, the system 500 includes an audio collector 510 configured to obtain a first audio signal captured by a device located in an environment. The system 500 also includes a processing unit 520 configured to analyze a characteristic of the first audio signal to determine an acoustic performance metric for the environment. The processing unit 520 is also configured to determine, in response to the acoustic performance metric being below a threshold, a first task for a user to perform based on the characteristic of the first audio signal, the first task being related to an adjustment to a setting of the environment.

In some example embodiments, the processing unit 520 may be further configured to determine, in response to the acoustic performance metric being below the threshold, a second task for the user to perform based on the characteristic of the first audio signal, the second task being related to an adjustment to a placement of the device.

In some example embodiments, the processing unit 520 may be further configured to determine an indication to guide the user to make sounds at a plurality of positions in the environment. The audio collector 510 may be configured to collect the sounds as the first audio signal.

In some example embodiments, the processing unit 520 may be configured to cause a first test signal to be generated by a loudspeaker of the device. The audio collector 510 may be configured to collect the first test signal by a microphone of the device as the first audio signal.

In some example embodiments, the processing unit 520 may be configured to analyze at least one of the following: a noise characteristic of the first audio signal indicating at least one of the following: a noise level, noise stability, or a relative level of a background speech in the first audio signal; an acoustic characteristic of the first audio signal indicating at least one of the following: a timbre of the first audio signal, a reverberation time of the first audio signal, an echo level of the first audio signal, or a rattle level of the first audio signal; a distance from a location of a sound source detected in the first audio signal to the device in the environment.

In some example embodiments, the device may support a spatial audio mode. In some example embodiments, the processing unit 520 may be configured to analyze at least one of the following: a span of locations of sound sources detected in the first audio signal in the environment; or a separation of sound sources detected in the first audio signal in a sound field.

In some example embodiments, the processing unit 520 may be configured to cause a second test signal to be generated by a loudspeaker of the device, and the audio collector 510 may be configured to collect the second test signal by a microphone of the device as a second audio signal. The processing unit 520 may be further configured to detect a distortion in the second audio signal to determine a quality metric for the device. In some example embodiments, in response to the quality metric of the device exceeding a threshold, the characteristic of the first audio signal is analyzed. In some embodiments, the device generating this second test signal may be an additional or related user device such as a mobile phone or may be peripheral equipment of the system 500.

In some example embodiments, the processing unit 520 may be further configured to determine, in response to the quality metric of the device being below the threshold, a third task for the user to modify a configuration of the device.

In some example embodiments, the system 500 may further include a characteristic collector configured to retrieve from a storage device the characteristic of a third audio signal captured by the device prior to the first audio signal. The processing unit 520 may be configured to determine the first task for the user further based on the characteristic of the second audio signal.

It is to be understood that the components of the system 500 may be a hardware module or a software unit module. For example, in some embodiments, the system may be implemented partially or completely as software and/or in firmware, for example, implemented as a computer program product embodied in a computer readable medium. Alternatively, or in addition, the system may be implemented partially or completely based on hardware, for example, as an integrated circuit (IC), an application-specific integrated circuit (ASIC), a system on chip (SOC), a field programmable gate array (FPGA), and so forth. The scope of the subject matter disclosed herein is not limited in this regard.

Figure 6:
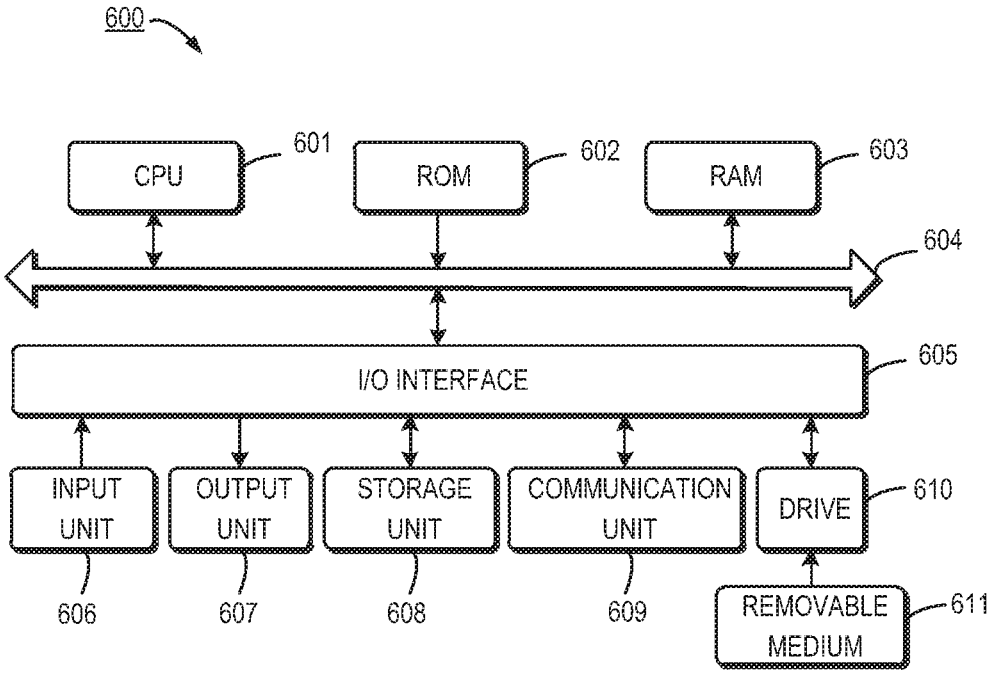
FIG. 6 is a block diagram of an example computer system suitable for implementing example embodiments disclosed herein.

FIG. 6 depicts a block diagram of an example computer system 600 suitable for implementing example embodiments disclosed herein. As depicted, the computer system 600 includes a central processing unit (CPU) 601 which is capable of performing various processes in accordance with a program stored in a read only memory (ROM) 602 or a program loaded from a storage unit 608 to a random access memory (RAM) 603. In the RAM 603, data required when the CPU 601 performs the various processes or the like is also stored as required. The CPU 601, the ROM 602 and the RAM 603 are connected to one another via a bus 604. An input/output (I/O) interface 605 is also connected to the bus 604.

The following components are connected to the I/O interface 605: an input unit 606 including a keyboard, a mouse, or the like; an output unit 607 including a display such as a cathode ray tube (CRT), a liquid crystal display (LCD), or the like, and a loudspeaker or the like; the storage unit 608 including a hard disk or the like; and a communication unit 609 including a network interface card such as a LAN card, a modem, or the like. The communication unit 609 performs a communication process via the network such as the internet. A drive 610 is also connected to the I/O interface 605 as required. A removable medium 611, such as a magnetic disk, an optical disk, a magneto-optical disk, a semiconductor memory, or the like, is mounted on the drive 610 as required, so that a computer program read therefrom is installed into the storage unit 608 as required.

Specifically, in accordance with example embodiments disclosed herein, the processes 200 to 400 described above with reference to FIGS. 2 to 4 may be implemented as computer software programs. That is, in some example embodiments disclosed herein a computer program product is included which includes a computer program tangibly embodied on a machine readable medium, the computer program including program code for performing the processes 200 to 400. In such embodiments, the computer program may be downloaded and mounted from the network via the communication unit 609, and/or installed from the removable medium 611.

Generally speaking, various example embodiments disclosed herein may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments disclosed herein are illustrated and described as block diagrams, flowcharts, or using some other pictorial representation, it will be appreciated that the blocks, apparatus, systems, techniques or methods disclosed herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, example embodiments disclosed herein include a computer program product including a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include, but not limited to, an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing.

Computer program code for carrying out methods disclosed herein may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server. The program code may be distributed on specially-programmed devices which may be generally referred to herein as "modules". Software component portions of the modules may be written in any computer language and may be a portion of a monolithic code base, or may be developed in more discrete code portions, such as is typical in object-oriented computer languages. In addition, the modules may be distributed across a plurality of computer platforms, servers, terminals, mobile devices and the like. A given module may even be implemented such that the described functions are performed by separate processors and/or computing hardware platforms.

As used in this application, the term "circuitry" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present. Further, it is well known to the skilled person that communication media typically embodies computer readable instructions, data structures, program modules or other data in a modulated data signal such as a carrier wave or other transport mechanism and includes any information delivery media.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of the subject matter disclosed herein or of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination.

Various modifications, adaptations to the foregoing example embodiments disclosed herein may become apparent to those skilled in the relevant arts in view of the foregoing description, when read in conjunction with the accompanying drawings. Any and all modifications will still fall within the scope of the non-limiting and example embodiments disclosed herein. Furthermore, other embodiments disclosed herein will come to mind to one skilled in the art to which those embodiments pertain having the benefit of the teachings presented in the foregoing descriptions and the drawings.

It will be appreciated that the embodiments of the subject matter disclosed herein are not to be limited to the specific embodiments disclosed and that modifications and other embodiments are intended to be included within the scope of the appended claims. Although specific terms are used herein, they are used in a generic and descriptive sense only and not for purposes of limitation.

Various features and aspects will be appreciated from the following enumerated example embodiments ("EEEs"):

EEE 1. A computer-implemented method comprising:

obtaining a first audio signal captured by a device located in an environment;

analyzing a characteristic of the first audio signal to determine an acoustic performance metric for the environment; and in response to the acoustic performance metric being below a threshold, providing a first task for a user to perform based on the characteristic of the first audio signal, the first task being related to an adjustment to a setting of the environment. The method may further comprise extracting a noise signal from the first audio signal and playing back the extracted noise signal by a speaker. Specifically, the extracted noise signal may be amplified before playback.

The first task may be related to addition, adjustment or removal of physical objects within the environment. In other words, aspects of the room itself may be modified by the user in order to reduce specular reflections or reverb which may cause problems with the timbre and intelligibility of speech pickup.

For example, the user may be interactively used as an active sound source, and the system may probe and score the generated sound. The idea is to use the performance metric as a single combined score to cover a complex set of characteristics related to the acoustical performance. In a next step, an acoustical or optical indication of the performance metric may be provided to the user, wherein the performance metric indicates whether the acoustic performance has improved or deteriorated. Since the user in the room may be unable to hear the benefits of the capture system tuning, the idea of a single score encourages continual improvement and gamification of the process. In particular, it is considered as a challenging task to get the user involved in the process of tuning the capturing environment e.g. by addition, adjustment or removal of physical objects within said environment.

The first audio signal may be captured by spatial microphones of the device, and the method may further comprise determining a direction of a noise source based on the first audio signal and providing a suggestion to the user based on the determined direction. Alternatively or additionally, in response to the acoustic performance metric being below the threshold, a fourth task for the user to perform based on the characteristic of the first audio signal may be provided, the fourth task being related to the usage of a microphone external to the device or to the usage of a speaker external to the device. Analyzing the characteristic of the first audio signal may comprise analyzing a rattle level of the first audio signal. In this case, the method may further comprise, in response to the acoustic performance metric being below the threshold, providing a firth task for the user to perform based on the analyzed rattle level, the fifth task being related to checking or adjusting objects surrounding the device. The first task may be prompted to the user via an audio signal.

EEE 2. The method of EEE 1, further comprising:

in response to the acoustic performance metric being below the threshold, providing a second task for the user to perform based on the characteristic of the first audio signal, the second task being related to an adjustment to a placement of the device.

EEE 3. The method of any of EEEs 1-2, wherein obtaining the first audio signal comprises:

providing an indication to guide the user to make sounds at a plurality of positions in the environment; and collecting the sounds as the first audio signal.

EEE 4. The method of any of EEEs 1-2, wherein obtaining the first audio signal comprises:

causing a first test signal to be generated by a loudspeaker of the device; and collecting the first test signal by a microphone of the device as the first audio signal.

EEE 5. The method of any of EEEs 1 to 4, wherein analyzing the characteristic of the first audio signal comprises analyzing at least one of the following:

a noise characteristic of the first audio signal indicating at least one of the following: a noise level, noise stability, or a relative level of a background speech in the first audio signal;

an acoustic characteristic of the first audio signal indicating at least one of the following: a timbre of the first audio signal, a reverberation time of the first audio signal, an echo level of the first audio signal, or a rattle level of the first audio signal; or a distance from a location of a sound source detected in the first audio signal to the device in the environment.

EEE 6. The method of any of EEEs 1 to 4, wherein the device supports a spatial audio mode, and wherein analyzing the characteristic of the first audio signal comprises analyzing at least one of the following:

a span of locations of sound sources detected in the first audio signal in the environment; or a separation of sound sources detected in the first audio signal in a sound field.

EEE 7. The method of any of EEEs 1 to 6, further comprising:

causing a second test signal to be generated by a loudspeaker of the device;

collecting the second test signal by a microphone of the device as a second audio signal; and detecting a distortion in the second audio signal to determine a quality metric for the device, wherein analyzing the characteristic of the first audio signal comprises:

in response to the quality metric of the device exceeding a threshold, analyzing the characteristic of the first audio signal.

EEE 8. The method of EEE 7, further comprising:

in response to the quality metric of the device being below the threshold, providing a third task for the user to modify a configuration of the device.

EEE 9. The method of any of EEEs 1 to 8, wherein providing the first task for the user further comprises:

retrieving from a storage device the characteristic of a third audio signal captured by the device prior to the first audio signal; and providing the first task for the user further based on the characteristic of the second audio signal.

EEE 10. A computer-implemented system comprising:

an audio collector configured to obtain a first audio signal captured by a device located in an environment; and a processing unit configured to:

analyze a characteristic of the first audio signal to determine an acoustic performance metric for the environment, and determine, in response to the acoustic performance metric being below a threshold, a first task for a user to perform based on the characteristic of the first audio signal, the first task being related to an adjustment to a setting of the environment.

EEE 11. The system of EEE 10, wherein the processing unit is further configured to determine, in response to the acoustic performance metric being below the threshold, a second task for the user to perform based on the characteristic of the first audio signal, the second task being related to an adjustment to a placement of the device.

EEE 12. The system of any of EEEs 10-11, wherein the processing unit is further configured to determine an indication to guide the user to make sounds at a plurality of positions in the environment; and wherein the audio collector is configured to collect the sounds as the first audio signal.

EEE 13. The system of any of EEEs 10-11, wherein the processing unit is further configured to cause a first test signal to be generated by a loudspeaker of the device; and wherein the audio collector is configured to collect the first test signal by a microphone of the device as the first audio signal.

EEE 14. The system of any of EEEs 10 to 13, wherein the processing unit is configured to analyze at least one of the following:

a noise characteristic of the first audio signal indicating at least one of the following: a noise level, noise stability, or a relative level of a background speech in the first audio signal;

an acoustic characteristic of the first audio signal indicating at least one of the following: a timbre of the first audio signal, a reverberation time of the first audio signal, an echo level of the first audio signal, or a rattle level of the first audio signal; or a distance from a location of a sound source detected in the first audio signal to the device in the environment.

EEE 15. The system of any of EEEs 10 to 13, wherein the device supports a spatial audio mode, and wherein the processing unit is configured to analyze at least one of the following:

a span of locations of sound sources detected in the first audio signal in the environment; or a separation of sound sources detected in the first audio signal in a sound field.

EEE 16. The system of any of EEEs 10 to 15, wherein the processing unit is configured to cause a second test signal to be generated by a loudspeaker of the device, and the audio collector is configured to collect the second test signal by a microphone of the device as a second audio signal; and wherein the processing unit is further configured to:

detect a distortion in the second audio signal to determine a quality metric for the device, and analyze, in response to the quality metric of the device exceeding a threshold, the characteristic of the first audio signal.

EEE 17. The system of EEE 16, wherein the processing unit is further configured to determine, in response to the quality metric of the device being below the threshold, a third task for the user to modify a configuration of the device.

EEE 18. The system of any of EEEs 10 to 17, further comprising:

a characteristic collector configured to retrieve from a storage device the characteristic of a third audio signal captured by the device prior to the first audio signal, and wherein the processing unit is further configured to determine the first task for the user further based on the characteristic of the second audio signal.

EEE 19. A computer program product, comprising a computer program tangibly embodied on a machine readable medium, the computer program containing program code for performing the method according to any of EEEs 1 to 9.

The invention claimed is:

1. A computer-implemented method comprising:

obtaining a first audio signal captured by a device located in an environment;

analyzing a characteristic of the first audio signal to determine an acoustic performance metric for the environment, wherein the acoustic performance metric is determined based at least in part on a measure of degradation of timbre in the captured first audio signal; and in response to the acoustic performance metric being below a threshold, providing a first task for a user to perform based on the characteristic of the first audio signal, the first task being related to an adjustment to a setting of the environment.

2. The method of claim 1, further comprising extracting a noise signal from the first audio signal; and playing back the extracted noise signal by a speaker.

3. The method of claim 2, wherein the first task is related to addition, adjustment or removal of physical objects within the environment.

4. The method of claim 1, further comprising:

providing an acoustical or optical indication of the performance metric to the user, wherein the performance metric indicates whether the acoustic performance has improved or deteriorated.

5. The method of claim 1, wherein the first audio signal is captured by spatial microphones of the device, the method further comprising determining a direction of a noise source based on the first audio signal; and providing a suggestion to the user based on the determined direction.

6. The method of claim 1, further comprising:

in response to the acoustic performance metric being below the threshold, providing a fourth task for the user to perform based on the characteristic of the first audio signal, the fourth task being related to the usage of a microphone external to the device or to the usage of a speaker external to the device.

7. The method of claim 1, wherein analyzing the characteristic of the first audio signal comprises analyzing a rattle level of the first audio signal, the method further comprising:

in response to the acoustic performance metric being below the threshold, providing a fifth task for the user to perform based on the analyzed rattle level, the fifth task being related to checking or adjusting objects surrounding the device.

8. The method of claim 1, further comprising prompting the first task to the user via an audio signal.

9. The method of claim 1, further comprising:

in response to the acoustic performance metric being below the threshold, providing a second task for the user to perform based on the characteristic of the first audio signal, the second task being related to an adjustment to a placement of the device.

10. The method of claim 1, wherein obtaining the first audio signal comprises:

providing an indication to guide the user to make sounds at a plurality of positions in the environment; and collecting the sounds as the first audio signal.

11. The method of claim 1, wherein obtaining the first audio signal comprises:

causing a first test signal to be generated by a loudspeaker of the device; and collecting the first test signal by a microphone of the device as the first audio signal.

12. The method of claim 1, wherein analyzing the characteristic of the first audio signal comprises analyzing at least one of the following:

a noise characteristic of the first audio signal indicating at least one of the following: a noise level, noise stability, or a relative level of a background speech in the first audio signal;

an acoustic characteristic of the first audio signal indicating at least one of the following: a timbre of the first audio signal, a reverberation time of the first audio signal, an echo level of the first audio signal, or a rattle level of the first audio signal; or a distance from a location of a sound source detected in the first audio signal to the device in the environment.

13. The method of claim 1, wherein the device supports a spatial audio mode, and wherein analyzing the characteristic of the first audio signal comprises analyzing at least one of the following:

a range of angles of sound sources detected in the first audio signal in the environment; or a separation of sound sources detected in the first audio signal in a sound field.

14. The method of claim 1, further comprising:

causing a second test signal to be generated by a loudspeaker of the device;

collecting the second test signal by a microphone of the device as a second audio signal; and detecting a distortion in the second audio signal to determine a quality metric for the device, wherein analyzing the characteristic of the first audio signal comprises:

in response to the quality metric of the device exceeding a threshold, analyzing the characteristic of the first audio signal.

15. The method of claim 13, further comprising:

in response to the quality metric of the device being below the threshold, providing a third task for the user to modify a configuration of the device.

16. The method of claim 1, wherein providing the first task for the user further comprises:

retrieving from a storage device the characteristic of a third audio signal captured by the device prior to the first audio signal; and providing the first task for the user further based on the characteristic of the third audio signal.

17. A computer-implemented system comprising:

an audio collector configured to obtain a first audio signal captured by a device located in an environment;

one or more processors; and a non-transitory computer-readable storage medium storing computer instructions which, when executed by the one or more processors, cause the one or more processors to perform:

analyzing a characteristic of the first audio signal to determine an acoustic performance metric for the environment, wherein the acoustic performance metric is determined based at least in part on a measure of degradation of timbre in the captured first audio signal, and determining, in response to the acoustic performance metric being below a threshold, a first task for a user to perform based on the characteristic of the first audio signal, the first task being related to an adjustment to a setting of the environment.

18. The system of claim 17, wherein the computer instructions which, when executed by the one or more processors, cause the one or more processors to perform determining, in response to the acoustic performance metric being below the threshold, a second task for the user to perform based on the characteristic of the first audio signal, the second task being related to an adjustment to a placement of the device.

19. The system of claim 17, wherein the computer instructions which, when executed by the one or more processors, cause the one or more processors to perform determining an indication to guide the user to make sounds at a plurality of positions in the environment; and wherein the audio collector is configured to collect the sounds as the first audio signal.

20. The system of claim 17, wherein the computer instructions which, when executed by the one or more processors, cause the one or more processors to perform causing a first test signal to be generated by a loudspeaker of the device; and wherein the audio collector is configured to collect the first test signal by a microphone of the device as the first audio signal.

21. The system of claim 17, wherein the computer instructions which, when executed by the one or more processors, cause the one or more processors to perform analyzing at least one of the following:

a noise characteristic of the first audio signal indicating at least one of the following: a noise level, noise stability, or a relative level of a background speech in the first audio signal;

an acoustic characteristic of the first audio signal indicating at least one of the following: a timbre of the first audio signal, a reverberation time of the first audio signal, an echo level of the first audio signal, or a rattle level of the first audio signal; or a distance from a location of a sound source detected in the first audio signal to the device in the environment.

22. The system of claim 17, wherein the computer instructions which, when executed by the one or more processors, cause the one or more processors to perform causing a second test signal to be generated by a loudspeaker of the device, and the audio collector is configured to collect the second test signal by a microphone of the device as a second audio signal; and wherein the processing unit is further configured to:

detect a distortion in the second audio signal to determine a quality metric for the device, and analyze, in response to the quality metric of the device exceeding a threshold, the characteristic of the first audio signal.

23. A non-transitory computer-readable storage medium storing computer instructions which, when executed by one or more processors, cause the one or more processors to perform the method according to claim 1.

* * * * *